United States Patent [19]

Furst

[11] 4,427,338

[45] Jan. 24, 1984

[54] THRUST CONTROL VANES FOR WATERJETS

[75] Inventor: Raymond B. Furst, Northridge, Calif.

[73] Assignee: Rockwell International Corporation, El Segundo, Calif.

[21] Appl. No.: 385,156

[22] Filed: Jun. 4, 1982

Related U.S. Application Data

[63] Continuation of Ser. No. 164,416, Jun. 30, 1980, abandoned.

[51] Int. Cl.[3] ..... F04D 29/54

[52] U.S. Cl. ..... 415/210; 415/216; 415/217; 60/221

[58] Field of Search ..... 415/216, 217, 210; 60/221

[56] References Cited

U.S. PATENT DOCUMENTS

| | | | |
|---|---|---|---|
| 2,029,813 | 2/1936 | DeMey | 415/216 |
| 3,047,753 | 7/1962 | Westell | 415/210 |
| 3,083,529 | 4/1963 | Hamilton | 60/221 |
| 3,249,083 | 5/1966 | Irgens | 60/221 |
| 3,389,558 | 6/1968 | Hall | 60/221 |
| 3,405,526 | 10/1968 | Aschauer | 60/221 |
| 3,839,859 | 10/1974 | Woell, Jr. | 60/221 |

*Primary Examiner*—Charles E. Phillips
*Assistant Examiner*—Brian J. Bowman
*Attorney, Agent, or Firm*—H. Fredrick Hamann; Harry B. Field

[57] ABSTRACT

The straightening vanes of a waterjet pump are designed to produce a low-pressure area, and the downstream side of the rotor drum is located inside said low-pressure area to eliminate the need for an axial thrust control seal.

2 Claims, 4 Drawing Figures

Fig. 1
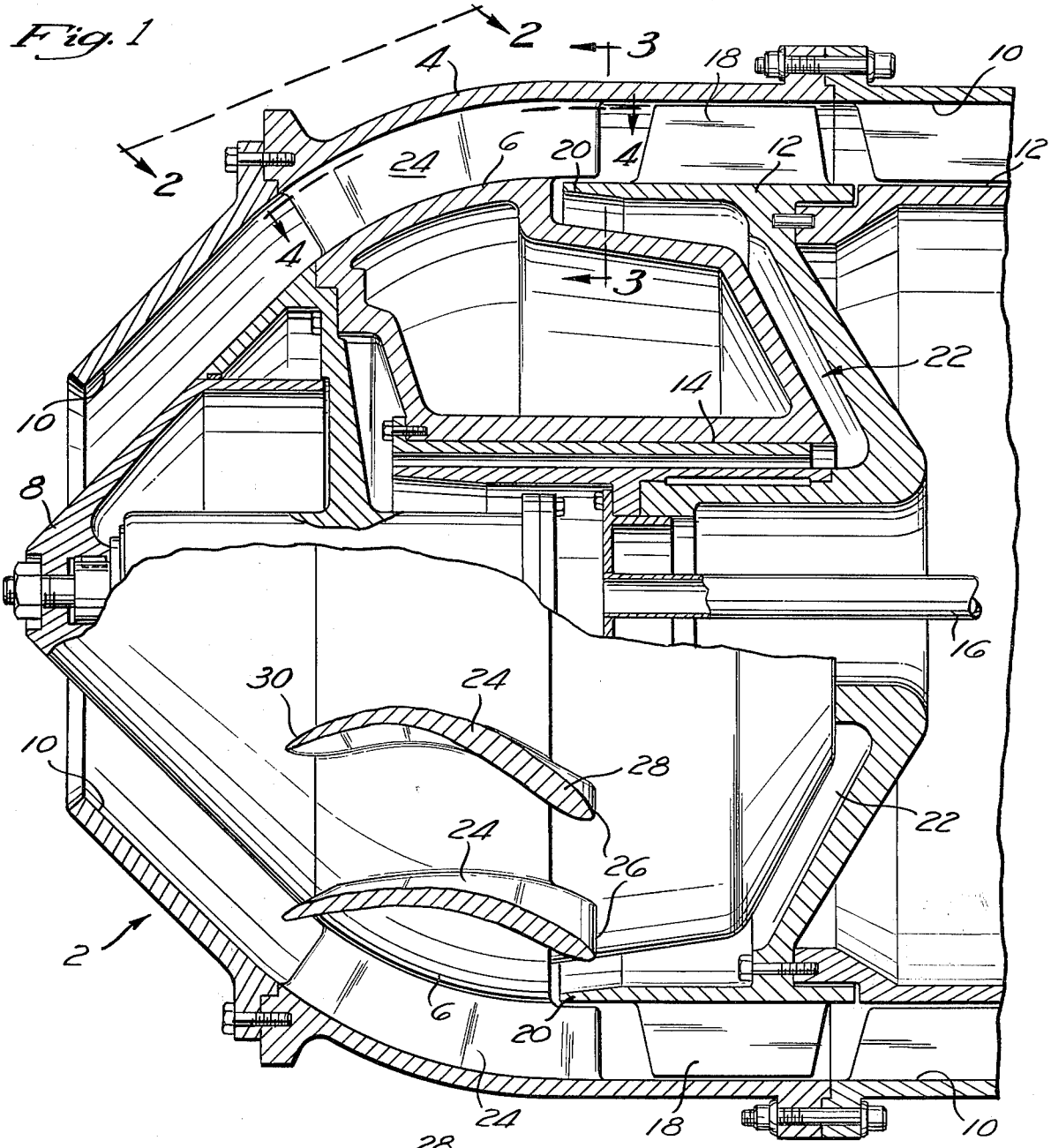
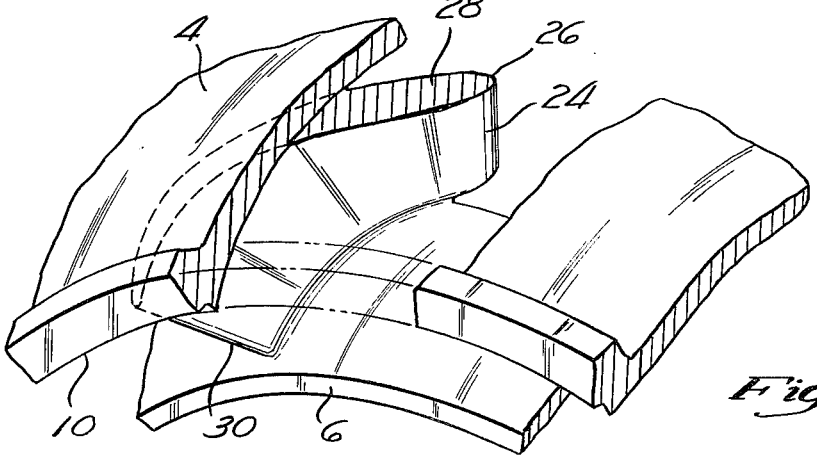
Fig. 2

THRUST CONTROL VANES FOR WATERJETS

The Government has rights in this invention pursuant to Contract N0002478-C-2370 awarded by the U.S. Department of Navy.

This is a continuation of application Ser. No. 164,416 filed June 30, 1980, now abandoned.

BACKGROUND OF THE INVENTION

1. Field of the Invention

This invention relates to waterjet pumps and is particularly directed to means for eliminating the need for an axial thrust control seal for waterjet pumps.

2. Description of the Prior Art

In waterjet pumps of the prior art, it has been customary to provide a seal to reduce axial thrust of the rotor against the aft bearings. Unfortunately, these seals have been highly susceptable to erosion by sand and the like with the result that the eroded seals have caused increased loads on the aft bearings, causing rapid deterioration of the aft bearings and increased maintenance for the pump.

Another problem of prior art waterjet pumps has been the fact that the action of the pump in driving the water has induced a helical motion in the pump discharge which tends to push the boat off course. To overcome this problem, it is common to provide flow straightening vanes aft of the rotor drum to straighten the discharge flow from the pump. The vane designs of the prior art have overcome the helical motion of the pump discharge, but have tended to increase the axial thrust load of the rotor drum and, hence, have increased seal erosion and bearing failure.

BRIEF SUMMARY AND OBJECTS OF THE INVENTION

These disadvantages of the prior art are overcome with the present invention and a waterjet pump is provided wherein the straightening vanes are designed to produce a low-pressure area, and the downstream side of the rotor drum is located inside this low-pressure area to eliminate the need for an axial thrust control seal.

Accordingly, it is an object of the present invention to provide improved waterjet pumps.

Another object of the present invention is to eliminate erosion of axial thrust control seals and reduce bearing failure in waterjet pumps.

An additional object of the present invention is to eliminate the need for axial thrust control seals in waterjet pumps.

A further object of the present invention is to provide improved means for straightening the discharge flow from waterjet pumps.

A specific object of the present invention is to provide a waterjet pump having straightening vanes designed to produce a low-pressure area and having the downstream side of the rotor drum located within said low-pressure area to eliminate the need for an axial thrust control seal.

These and other objects and features of the present invention will be apparent from the following detailed description, taken with reference to the accompanying drawing.

BRIEF DESCRIPTION OF THE DRAWINGS

FIG. 1 is a diagrammatic representation of the aft portion of a waterjet pump embodying the present invention.

FIG. 2 is a detail view, taken on the line 2—2 of FIG. 1, with the cover plate broken away.

DETAILED DESCRIPTION OF THE PREFERRED EMBODIMENTS

Figure 3:
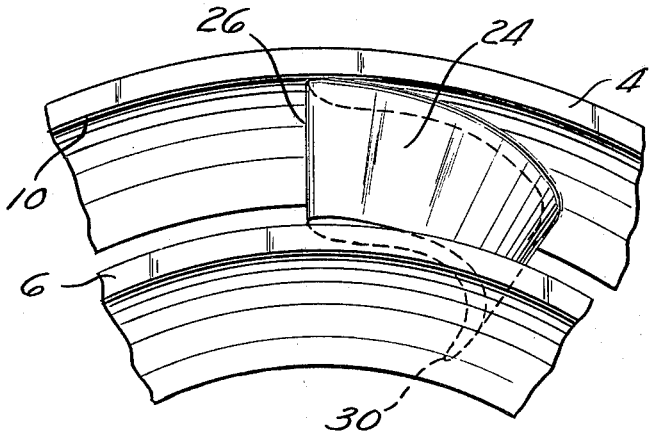
FIG. 3 is a transverse section, taken on the line 3—3 of FIG. 1.

In that form of the present invention chosen for purposes of illustration, FIG. 1 shows a waterjet pump, indicated generally at 2, having an outer housing 4 with interior fixed portions 6 and 8, interior fixed portion having a forward peripheral edge 9, defining a fluid passageway 10. Rotor means 12 is journalled in bearing 14, and is rotated by drive shaft 16 to drive impeller blades 18 to force fluid through the passageway 10.

In prior art pumps, it has been conventional to provide a fluid seal at the aft end 20 of the rotor 12 so as to provide low fluid pressure in the region 22 between the rotor 12 and stationary member 6 to relieve pressure on the thrust bearing (not shown) located adjacent the forward end of the rotor 12. Unfortunately, such seals are readily eroded by sand and the like, and frequently result in increased loads on the bearings and cause substantially increased maintenance. Furthermore, since the action of the impeller blades 18 tends to induce a helical motion in the flow of fluid through passageway 10 which decreases the effective thrust of the pump output, it has been common to provide a plurality of straightening vanes, such as vanes 24, aft of the rotor 12, to prevent such helical motion. In the past, the straightening vanes have served only to prevent the helical motion. Consequently, the vanes of the prior art have been formed with relatively sharp leading edges and with relatively thin dimensions in the direction transverse to the flow, so as to provide minimal drag.

Figure 4:
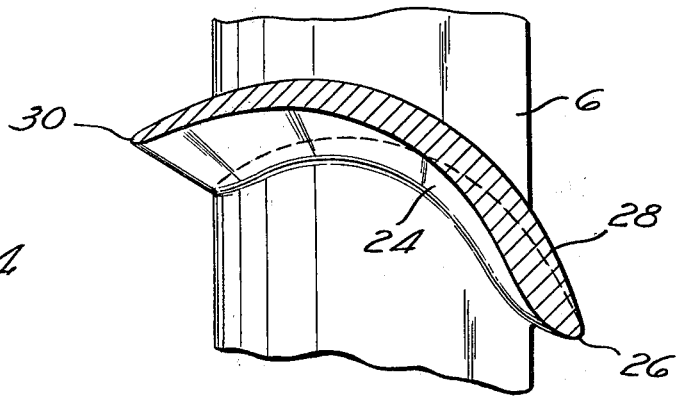
FIG. 4 is a horizontal section, taken on the line 4—4 of FIG. 1.

In contrast with such prior art teaching, the present invention teaches that the blades 24 should be formed with a relatively blunt leading edge, as seen at 26, with the vane thickness adjacent the leading edge 26, as seen at 28 in FIG. 4, being at least twice the vane thickness adjacent the trailing edge of the vane 24, as seen at 30 in FIG. 4. By forming the vanes 24 in this manner, it is found that a low-pressure region is established in the area 22 adjacent the aft end 20 of the rotor 12, such that the need for a fluid seal at this point is eliminated without adverse effects on the thrust bearing. Moreover, it is found that particulate matter, such as sand, tends to be carried with the high-pressure portion of the flow, and is retarded from entering the area 22.

Obviously numerous variations and modifications may be made without departing from the present invention. Accordingly, it should be clearly understood that the form of the present invention described above and shown in the accompanying drawings is illustrative only, and is not intended to limit the scope of the invention.

What is claimed and desired to be secured by Letters Patent of the United States is:

1. A waterjet pump comprising:

a housing comprising fixed means for defining a fluid passageway including an interior portion having a forward peripheral edge;

a rotor drum having an aft end and an impeller blade means formed thereon said aft end being axially spaced apart from and substantially coaxial to said peripheral edge of said housing; and a plurality of fixed flow-straightening vanes mounted to said housing and projecting into said fluid passageway, said vanes having blunted leading edges located over said aft end of said rotor drum and said vanes having a thickness adjacent to the leading edge of said vanes greater than a thickness adjacent the trailing edge of said vanes.

2. The device of claim 1 wherein the vane thickness of said flow straightening vanes adjacent the leading edge of said vanes is at least twice the vane thickness adjacent the trailing edge of said vanes.

* * * * *